US009926120B2

(12) United States Patent
Dapper et al.

(10) Patent No.: US 9,926,120 B2
(45) **Date of Patent: *Mar. 27, 2018**

(54) ARRAY OF INTER-CONNECTED PALLETIZED PRODUCTS

(71) Applicant: The Procter & Gamble Company, Cincinnati, OH (US)

(72) Inventors: Steven Dan Dapper, Albany, GA (US); Gustav André Mellin, Amberley Village, OH (US); Paul Dennis Trokhan, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/437,473

(22) Filed: Feb. 21, 2017

(65) Prior Publication Data

US 2017/0158401 A1 Jun. 8, 2017

Related U.S. Application Data

(63) Continuation of application No. 14/660,081, filed on Mar. 17, 2015, now Pat. No. 9,598,213.

(51) Int. Cl.

| | |
|---|---|
| ***B65D 73/00*** | (2006.01) |
| ***B65D 71/00*** | (2006.01) |
| ***B65D 71/06*** | (2006.01) |
| ***B65D 85/672*** | (2006.01) |
| ***B65D 21/02*** | (2006.01) |

(52) U.S. Cl.

CPC ..... *B65D 71/0096* (2013.01); *B65D 21/0205* (2013.01); *B65D 71/063* (2013.01); *B65D 71/066* (2013.01); *B65D 85/672* (2013.01); *B65D 2313/10* (2013.01); *B65D 2571/00043* (2013.01)

(58) Field of Classification Search

CPC ..... B65D 73/0028; B65D 71/0096; B65D 71/063; B65D 21/0205; B65D 33/008; B65D 2571/00043; B65D 2313/10

USPC ..... 206/386, 460, 497, 499, 503, 504, 813

See application file for complete search history.

(56) References Cited

U.S. PATENT DOCUMENTS 3,113,673 A * 12/1963 Stein ..... B65D 5/4275 206/813
3,759,378 A * 9/1973 Werth ..... B65D 21/0205 206/192
4,050,579 A 9/1977 Gorski et al.
(Continued)

FOREIGN PATENT DOCUMENTS

CA 2199699 C 7/2002
CA 2499252 C 3/2010
(Continued)

OTHER PUBLICATIONS

PCT International Search Report, dated May 23, 2016, 32 pages.

*Primary Examiner* — Luan K Bui
(74) *Attorney, Agent, or Firm* — Andrew J. Mueller

(57) ABSTRACT

A collection of stackable articles is disclosed. Each stackable article of the collection of stackable articles has a bottom, at least one sidewall, and a top. The collection of stackable articles comprises a supporting medium, a first slip sheet disposed upon a surface of the supporting medium, and a first plurality of the stackable articles arranged in a first layer upon the first slip sheet.

12 Claims, 15 Drawing Sheets

(56) References Cited

U.S. PATENT DOCUMENTS

| | | | | |
|---|---|---|---|---|
| 4,365,710 | A * | 12/1982 | Swanson | B65D 5/42 108/51.3 |
| 4,418,111 | A | 11/1983 | Carstens | |
| 4,452,723 | A | 6/1984 | Carstens | |
| 4,692,370 | A | 9/1987 | Reckziegel et al. | |
| 4,753,831 | A | 6/1988 | Hosoyamada et al. | |
| 4,998,619 | A * | 3/1991 | Sowa | B65D 71/0096 108/53.5 |
| 5,339,957 | A | 8/1994 | Carstens | |
| 5,551,563 | A * | 9/1996 | Allen | B65D 71/0096 206/394 |
| 5,657,870 | A | 8/1997 | Schöttle et al. | |
| 5,887,717 | A | 3/1999 | Andersen et al. | |
| 5,895,540 | A * | 4/1999 | David | B65B 17/02 156/226 |
| 6,499,596 | B1 * | 12/2002 | Andersen | B65B 15/00 206/427 |
| 7,048,817 | B1 | 5/2006 | Hammond | |
| 7,392,905 | B2 | 7/2008 | Andersen et al. | |
| 7,634,894 | B2 * | 12/2009 | Yohe | B65G 57/03 414/792.6 |
| 8,404,079 | B1 | 3/2013 | Kueppers et al. | |
| 2007/0007158 | A1 * | 1/2007 | Cordes | B65D 71/0085 206/431 |
| 2008/0041752 | A1 | 2/2008 | Schormair | |
| 2011/0147388 | A1 | 6/2011 | Thomann et al. | |
| 2013/0004624 | A1 | 1/2013 | Chassard et al. | |
| 2014/0144802 | A1 | 5/2014 | Maginas | |
| 2015/0108036 | A1 * | 4/2015 | Sakaguchi | B65D 71/0096 206/597 |

FOREIGN PATENT DOCUMENTS

| | | | |
|---|---|---|---|
| CH | 652093 | A5 | 10/1985 |
| DE | 2408797 | B2 | 7/1979 |
| DE | 3431002 | A1 | 3/1986 |
| DE | 3436620 | A1 | 4/1986 |
| DE | 4227713 | A1 | 2/1994 |
| DE | 19627776 | A1 | 1/1998 |
| DE | 20307340 | U1 | 7/2003 |
| DE | 102008059376 | A1 | 10/2009 |
| EP | 0408900 | A1 | 1/1991 |
| EP | 0278888 | B1 | 6/1993 |
| FR | 1520339 | A | 4/1968 |
| FR | 2354928 | A1 | 1/1978 |
| FR | 2675774 | A1 | 10/1992 |
| GB | 2190065 | A | 11/1987 |
| GB | 2 412 904 | A | 10/2005 |
| JP | S5648373 | B2 | 11/1981 |
| KR | 20070031446 | | 3/2007 |
| MX | 9303202 | A | 1/1994 |
| WO | WO-96/17791 | | 6/1996 |
| WO | WO-03/042044 | A1 | 5/2003 |

* cited by examiner

ARRAY OF INTER-CONNECTED PALLETIZED PRODUCTS

This application is a CON of Ser. No. 14/660,081 filed on Mar. 17, 2015, U.S. Pat. No. 9,598,213.

FIELD OF THE INVENTION

The present disclosure generally relates collections of stacked articles that are placed upon a pallet for shipping. More particularly, the present disclosure relates to an array of individual articles containing products placed upon a pallet for shipping that are interconnected within a layer.

BACKGROUND OF THE INVENTION

Large numbers of articles such as cans, bottles and other such cylindrical or curvilinear containers are conventionally palletized in a rapid and mechanized manner. This system is ubiquitous in industries where transport of unit loads is required. Generally a pallet is a flat transport structure which provides stability and supports unit loads while being lifted by a forklift or other jacking device. It is also common in industries where unit loads are transported in containers to a destination. Pallets are usually wooden, but can also be constructed of plastic or other materials. Each material in the current art is selected for varying properties and purposes. The term "palletized" has come to mean the mounting of the desired articles, or load, atop a wooden pallet. Optionally, the articles are fixed to the pallet by a fastening means such as shrink wrap or straps.

Palletizing articles generally involves an accumulator belt which delivers the articles to a tier forming area. The articles are then conveyed onto the pallet until the pallet is substantially filled with the articles-thereby forming a tier. The tiers, or layers, of articles are generally arranged to form transverse rows of differing, usually alternating orientations. Accordingly, the natural arrangement of a tier is to form the initial transverse row in the tier of one orientation with the next row having a second orientation.

After the first layer of articles are placed upon the pallet, the pallet is then lowered approximately the height of the article. A separator sheet is then disposed upon the assembled layer of articles. Additional articles are then conveyed onto the separator sheet to form another tier of articles. This operation is repeated until a multi-tier load is formed.

This form of palletization is quite common in manufacturing operations. The patterns of tiers are carefully predetermined for the purpose of economical utilization of space and for proper interfacing with subsequent operations. It is not unusual for such palletized loads to extend up to ten or fifteen feet in height. Accordingly, it is most important that each tier be properly positioned and oriented both in relationship to other tiers and to the pallet.

The articles (or packages of merchandise or products) that are conventionally loaded onto such pallets are then generally secured to the pallet for transportation. One method employed to secure individual packages or containers on a pallet is to bind them horizontally and vertically with metal bands or the like. For example, one approach is to enclose article-loaded pallets with loosely fitting bags of heat-shrinkable plastic film. Exposing the heat-shrinkable plastic film to a suitable heat treatment will cause the film to shrink into conforming engagement with the articles. Although this approach can also be utilized to secure the articles on a pallet without the need for straps or bands, the machinery necessary for heating the film enclosed pallet is rather bulky and expensive to operate. In addition, this approach is limited to articles that are not susceptible to heat damage during the film shrinkage process.

Another manner to secure pallatized articles is to tension wrap polyethylene stretch film around the articles until at least a thickness of several layers is achieved and then heat seal the trailing edge of the film to the underlying film wraps. This process requires a means for first securing the leading edge of the film to the article-loaded pallet and then heating means to secure the trailing edge of the film to an area on the underlying layers of film. Thus the heat treated area about the trailing edge is the only area that provides the sole means for securing the film to itself and containing the articles on the pallet. If the trailing edge comes loose, the film will be subject to immediate loss of tension and unwrapping.

However, conventional palletizing approaches result in a variety of problems. For example, when palletized materials are stacked one upon the next, there is a tendency for the stack to lean. Further, the runners of an upwardly-disposed pallet sometimes indent or distort the packaging of the materials. Nails utilized with wooden pallets may also damage the materials during handling.

In response to these and other problems, another form of palletizing, sometimes referred to as "slip sheet" palletizing", was developed. A slip sheet has a load-bearing surface on which materials (e.g., rolled absorbent materials for use in an absorbent article) are capable of being stacked vertically. With the slip sheet approach, materials are stacked on each other, but have a thin slip sheet positioned between adjacently stacked materials. Despite its benefits, however, slip sheet palletizing still possesses various problems, particularly for soft and flexible materials. For instance, when stacking multiple materials, the increased weight causes the entire stack to lean slightly. Even if the stack does not fall, the leaning imparts increased pressure to the outer edges of the materials. When the material is relatively soft and flexible, this increased pressure can cause the outer edges to be indented and deformed, which is obviously undesired. In many instances, these deformed materials must actually be discarded.

Additionally, the use of slip sheets produces additional waste material at the site of unloading the pallet. The personnel that are charged with unloading, or unstacking, the materials stacked upon the pallet, must remove and dispose of the slip sheets. The removal of the slip sheets can cause a decrease in efficiency due to the additional time required to remove the slip sheet as well as time to either stack the slip sheet with other slip sheets removed from the un-palletizing operation, or to dispose of the slip sheet. Further, slip sheets are usually not recycled for further use and usually end up as landfill material. Clearly, the use of slip sheets in current palletizing operations is a necessary evil. While the slip sheets are functional to provide a pallet of stacked materials with necessary stability, the end result of the use of slip sheets is clearly a time and environmental liability.

As such, a need currently exists for a system and method for more effectively stacking materials to provide a pallet of stacked materials with the needed stability for shipping, eliminate any un-needed or unnecessary steps at unloading, and reduce, or eliminate the amount of land-filled material. This can be particularly problematic with the palletizing of relatively soft and flexible materials.

SUMMARY OF THE INVENTION

The present disclosure provides for a collection of stackable articles. Each stackable article of the collection of stackable articles has a bottom, at least one sidewall, and a top. The collection of stackable articles comprises a supporting medium, a first slip sheet disposed upon a surface of the supporting medium, and a first plurality of the stackable articles arranged in a first layer upon the first slip sheet. The supporting medium is selected from the group consisting of a basket, a bin, a box, a case, a catch-all, a chest, a container, a crate, a envelope, a mold, a packing case, a packing crate, a pallet, a pocket, a receptacle, and a tin. Each stackable article of the collection of stackable articles is disposed adjacent each other so that a first at least one sidewall of a first stackable article of the collection of stackable articles is disposed immediately adjacent a first at least one sidewall of a second stackable article of the collection of stackable articles to define a first space therebetween. A first portion of the first at least one sidewall of the first stackable article of the collection of stackable articles disposed within the first space is bonded to a first portion of the first at least one sidewall of the second stackable article of the collection of stackable articles disposed within the first space when the first stackable article of the collection of stackable articles and the second stackable article of the collection of stackable articles are placed into contacting engagement.

The present disclosure also provides for a collection of disposable rolled products. Each disposable rolled product of the collection of disposable rolled products has a bottom, a sidewall, a top, and a longitudinal axis. The collection of disposable rolled products comprises a supporting medium and a first plurality of the collection of disposable rolled products arranged in a first layer upon the supporting medium so each longitudinal axis of each of the disposable rolled products arranged in the first layer is parallel. The supporting medium is selected from the group consisting of a basket, a bin, a box, a case, a catch-all, a chest, a container, a crate, a envelope, a mold, a packing case, a packing crate, a pallet, a pocket, a receptacle, and a tin. Each disposable rolled product of the first plurality of the collection of disposable rolled products is disposed adjacent each other so that a sidewall of a first disposable rolled product of the first plurality of the collection of disposable rolled products is disposed immediately adjacent a sidewall of a second disposable rolled product of the first plurality of the collection of disposable rolled products to define a first space therebetween. A first portion of an adhesive is disposed upon the sidewall of the first disposable rolled product of the first plurality of the collection of disposable rolled products within the first space to adhesively connect the first disposable rolled product to the second disposable rolled product when the second disposable rolled product is placed into contacting engagement thereto.

DETAILED DESCRIPTION

The term "machine direction" means the direction of process flow of a product on a conveyor or assembly line (i.e., a direction generally perpendicular to the cross direction). The term "cross direction" means the direction generally perpendicular to the direction of process flow of a product on a conveyor or assembly line (i.e., a direction generally perpendicular to a machine direction). The term "Z-direction" means the direction generally perpendicular to both the machine and cross-machine directions.

Figure 1:
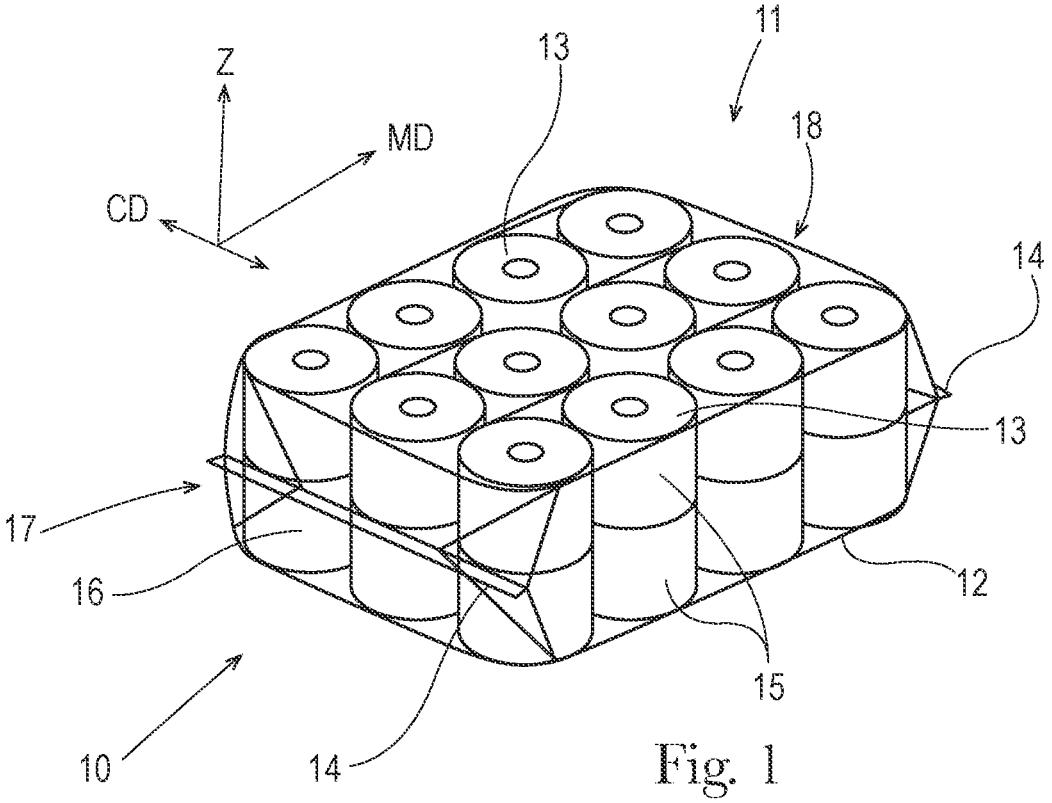
FIG. 1 is a perspective view of an article suitable for use with the present disclosure.

Turning now to the accompanying drawings and initially to FIG. 1, an article 10 provided as a carton 11 (also referred to herein as package 11, or large count package 11) suitable for use in the present invention is generally shown. The carton 11 is typically capable of containing goods packaged inside of the carton 11. By way of non-limiting example, article 10 provided as a large count package containing a plurality of disposable rolled products 13. Disposable rolled products 13 or disposable rolled absorbent products 13 or disposable rolled paper products 13 can include paper towels, facial tissues, toilet tissues, shop towels, wipes, and the like. Such disposable rolled products 13 are generally made from one or more webs of fibers, such as cellulose fibers or nonwoven fibers. Each disposable rolled product is generally cylindrical in shape and will typically have a longitudinal axis.

The term "large count package" means a package comprising multiple individually wrapped packages of two or more rolled products or a plurality of naked rolls of products enclosed, or at least partially enclosed, in an overwrap, such as a film overwrap. In exemplary embodiments, a large count package 11 can have a general parallelepiped shape which can manifest itself as a generally cuboid shape, a generally rectangular cuboid shape, or any other suitable shape. Although one of skill in the art will realize that a large count package can have virtually any three-dimensional shape and still be suitable for use with the innovation of the present disclosure. In an embodiment where the large count package 11 has a generally rectangular cuboid shape, or a cuboid shape, the large count package 11 can comprise six sides. The sides can be arranged in three pairs of generally parallel opposing sides. A first pair of the opposing sides (sidewalls) can be a top side and a bottom side. A second pair of the opposing sides can be a front side and a back side. A third pair of the opposing side can be a left side and a right side. Point-of-sale indicia (i.e., branding materials, other indicia, and/or other materials that a consumer sees when purchasing a product at a retail store) can be printed or positioned on any of the top, bottom, front, back, left, and right sides. In other various embodiments, such indicia or other materials may only be printed or positioned on the top, front, back, left, and right sides, for example. In still other various embodiments, such indicia or other materials can be printed or positioned on one or more sides of the large count package 11. The present invention is therefore not limited to the use of a particular carton 11 having a particular shape or size.

In an exemplary embodiment, a large count package 11 can comprise two or more individually wrapped packages of disposable rolled products 13. Exemplary individually wrapped disposable rolled product 13 can comprise at least two stacks of at least two individual toilet or bath tissue rolls 15. A longitudinal axis of each of the cores of each stack of at least two individual toilet or bath tissue rolls 15 can be generally parallel and aligned with each other and adjacent stack(s) of at least two individual toilet or bath tissue rolls 15 can lie in generally the same plane as the other stack(s) of at least disposable rolled products 13. The longitudinal axis of each stack of at least two individual toilet or bath tissue rolls 15 can be generally parallel to the sidewall of a respective large count package. The outer individual toilet or bath tissue rolls 15 contained within a large count package 11 are usually in contacting engagement with the material that forms the large count package 11.

In various embodiments, the individually wrapped packages of at least two individual toilet or bath tissue rolls 15 can each comprise two or more rolls of product, such as two, three, four, six, eight, nine, ten, twelve, or fifteen rolls of product, for example. Those of skill in the art will recognize that other numbers of rolls of product can be useful in individually wrapped packages depending on a desired configuration of a particular large count package or a consumer need. The two or more rolls of individual toilet or bath tissue rolls 15 can be stacked on top of each other and each stack can be positioned adjacent to another stack within the individually wrapped package of at least two individual toilet or bath tissue rolls 15. In such an embodiment, a longitudinal axis of each of the cores of the two or more rolls of product in each stack can be generally parallel and aligned and each stack can be in the same plane, or in generally the same plane, as each adjacent stack. In other various embodiments, the two or more rolls of individual toilet or bath tissue rolls 15 can be positioned generally in a side-by-side fashion with respect to each other.

Referring again to FIG. 1, a large count package 11 for disposable rolled products 13 can encase individual toilet or bath tissue rolls 15, can be stacked two high vertically and then feed into a bundler, with a longitudinal axis of each core of each individual toilet or bath tissue rolls 15 being oriented in a generally vertical direction. The bundler is a piece of machinery that applies an overwrap 12 and creates seals 14 in the overwrap 12 to form large count packages 11. The longitudinal axis of each core of each individual toilet or bath tissue roll 15 is generally parallel to a longitudinal axis of a core of another individual toilet or bath tissue roll 15 in the stack of the rolls 16. When the individual toilet or bath tissue rolls 15 are fed into the bundler in such an orientation, the overwrap 12 is positioned around the stacks of the rolls 16 and gusset seals 14 are formed on the leading side 17 and trailing side 18 of large count pack 11 in a direction generally parallel to the cross-machine direction (i.e., a direction generally parallel with a surface of a conveyor on which the large count package 11 rests). It should also be understood that large count package 11 can have seals or gusset seals formed on the top and bottom sides thereof.

As shown in FIG. 1, a large count package 11 encased in an overwrap 12 of sealed or unsealed polymer film, or other film or material, can comprise seals or gusset seals 14 on the opposed cross-machine direction sides of large count package 11 as well as any top and/or bottom sides thereof (bottom seal or gusset seal not illustrated). The overwrap 12 can hold individual or individually wrapped packages of at least two individual toilet or bath tissue rolls 15 together to form the large count package 11 into a rectangular cuboid shape or cuboid shape (i.e., parallelepiped) and add to its stability. Each roll of product can be wound about a paper, cardboard, paperboard, or corrugate tube to form a core through each roll. Each core can define a longitudinal axis extending therethrough. In other various embodiments, the rolls of individual toilet or bath tissue rolls 15 may not comprise the paper, cardboard, paperboard, or corrugate tube, but instead the individual toilet or bath tissue rolls 15 can be wound about itself to form a roll while still forming a core defined through each roll. The void area in the center of each roll of individual toilet or bath tissue rolls 15 where the product winds about itself can be considered a "core" for purposes of this disclosure. Such rolls are known in the art as "coreless" rolls. In such embodiments, the same principals of the present disclosure, including the orientation of the rolls within the various individually wrapped packages and large count packages, can be applied to "coreless" rolls.

In one embodiment, the large count package 11 can comprise 24 rolls of the disposable rolled products 13, but, the present disclosure is not limited to such a number of rolls within any particular large count package 11. In fact, any suitable number of rolls equal to or greater than 4 can be combined into a large count package. In various example embodiments, a large count package can comprise 6 rolls, 8 rolls, 9 rolls, 12 rolls, 16 rolls, 18 rolls, 20 rolls, 24 rolls, 27 rolls, 30 rolls, 32 rolls, 36 rolls, 40 rolls, 45 rolls, 48 rolls, 54 rolls, 60 rolls, or 72 rolls, for example, or any other suitable number of rolls. The method of packaging a large count package 10 of the present disclosure permits greater flexibility in the number of rolls and configurations of rolls that can be provided in a specific large count package 10.

Figure 2:
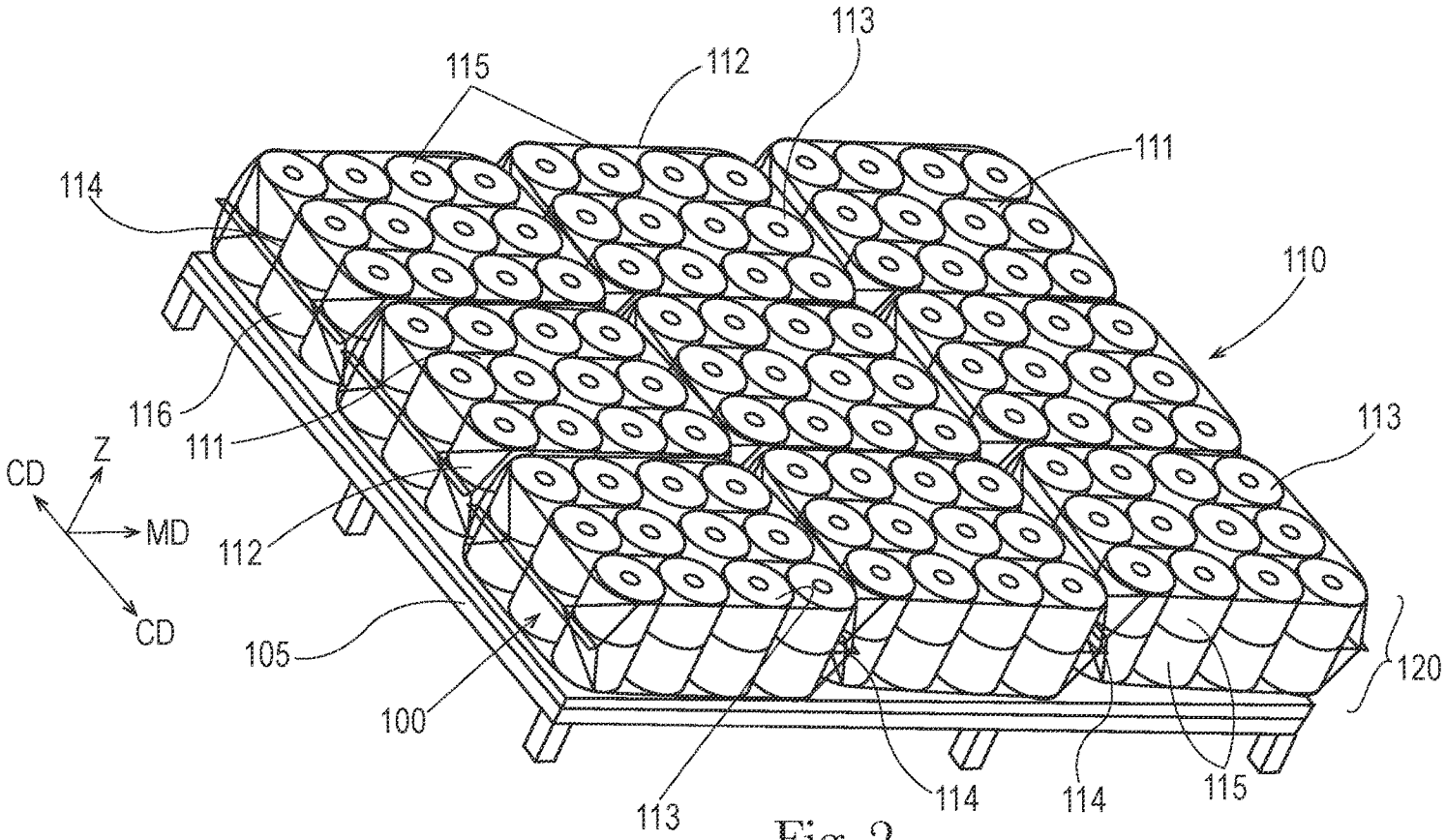
Fig. 2 (PRIOR ART)
FIG. 2 is a perspective view of a prior art example of a layer comprising a plurality of the articles of FIG. 1 disposed upon a pallet.

Referring to the prior art, FIG. 2 depicts a typical presentation of a plurality of articles 100 oriented and disposed upon a pallet 105. This presentation can be considered as exemplary of the manner in which a plurality of articles 100 can be stacked upon a pallet 105. A typical pallet 105, such as a shipping and/or display pallet, for example, can be rectangular, for example. As known to those of skill in the art, a rectangle can include a square. In one embodiment, the pallet 105 can comprise four sides, each side comprising an edge positioned adjacent to a pallet surface, wherein the edges together form a surface perimeter. The surface can be configured to receive or support the large count packages 11. In one embodiment, a material suitable for use as a slip sheet, such a paperboard, for example, can be positioned on the surface to protect the large count packages 11 from damage.

Each of the plurality of articles 100 can be provided as a carton 111 (also referred to herein as package 111, or large count package 111) as is generally shown. Each carton 111 can be provided as a large count package 111 for containing disposable rolled products 113 provided as individual toilet or bath tissue rolls 115 that can be stacked two high vertically. A bundler can apply an overwrap 12 and create seals 114 in the overwrap 112 to form each large count package 111. The longitudinal axis of each core of each individual toilet or bath tissue roll 115 is generally parallel to a longitudinal axis of a core of another individual toilet or bath tissue roll 15 in the stack of the rolls 16. The plurality of articles can be considered a first layer 120 of articles 100 disposed upon a supporting medium such as an exemplary pallet 105. A plurality of devices can provide a supporting medium for the stacking of articles 100 thereon. This can include a basket, a bin, a box, a case, a catch-all, a chest, a container, a crate, a envelope, a mold, a packing case, a packing crate, a pallet, a pocket, a receptacle, and a tin. However, for purposes of the present disclosure, supporting medium will be generally referred to, and described by, the non-limiting embodiment of pallet 105.

Figure 3:
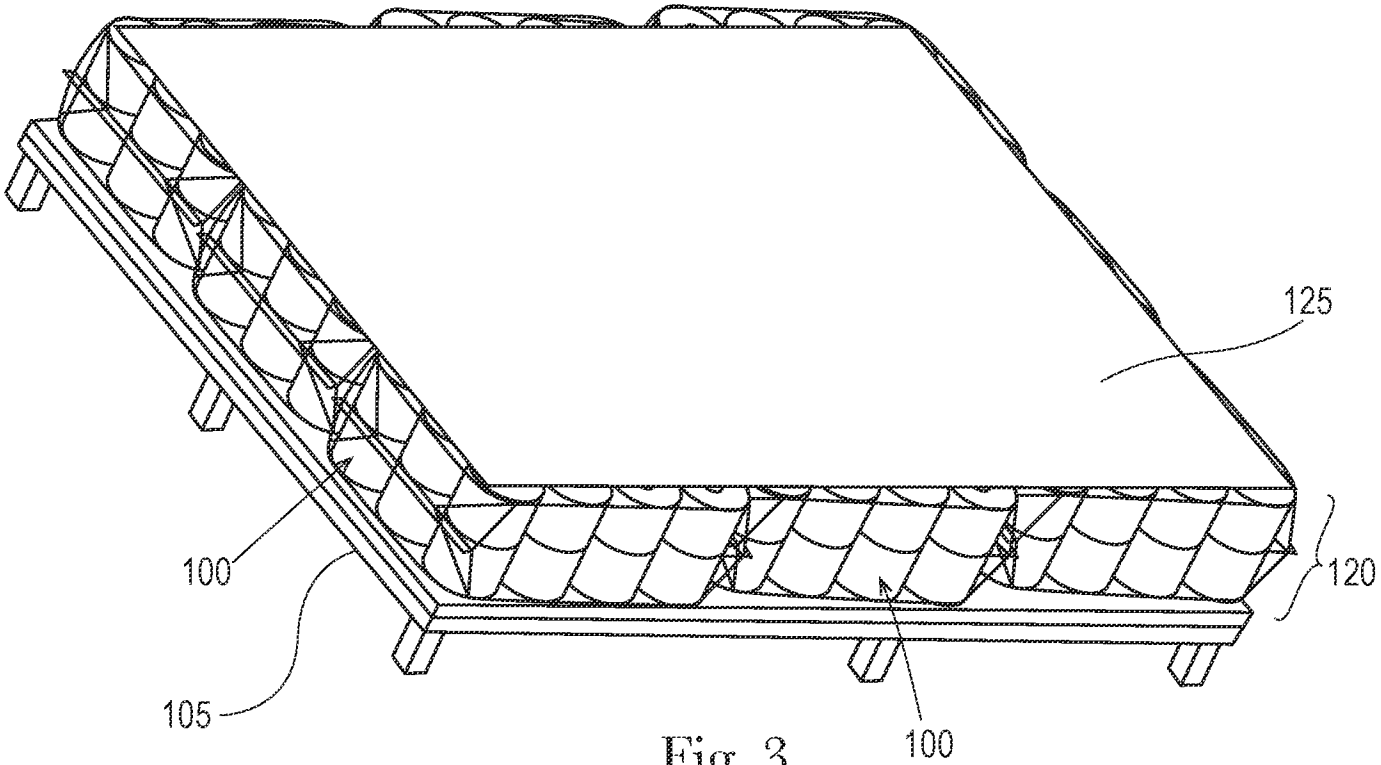
Fig. 3 (PRIOR ART)
FIG. 3 is a perspective view of the prior art example of FIG. 2 having a slip sheet disposed thereon.

An exemplary supporting medium, such as pallet 105, can be provided as a flat, rectangular or square. In the usual storage operation, the length and width of the articles 100 are proportioned in such a manner as to permit particular articles 100 that are carried upon a pallet 105 to be made up of a selected number of layers of articles 100 with each layer of articles 100 forming a rectangle or square of selected proportions which has the same size footprint as the pallet 105. The articles 100 of each layer in the load can be arranged in an interlocking pattern with respect to the articles 110 of adjacent layers to maintain the integrity of the load. In FIG. 1, the first layer 120 of articles 100 is depicted as having a square base with nine articles in the first layer 120. First layer 120 and any additional layers of articles 100 can be arranged in an interlocking pattern. Referring to FIG. 3, to complete the first layer 120, a first slip sheet 125 is placed upon the top of the first layer 120 of articles 100 to form a protective surface whereon an additional layer of articles 100 can be placed. First slip sheet 125 can also provide additional structural stability to the final arrangement of articles 100 disposed upon pallet 105. Ostensibly, this is to reduce the inertia created by the columnization of a stack of articles 100. It is also interesting to note that there is no interconnection between individual articles 100 comprising first layer 120.

Figure 4:
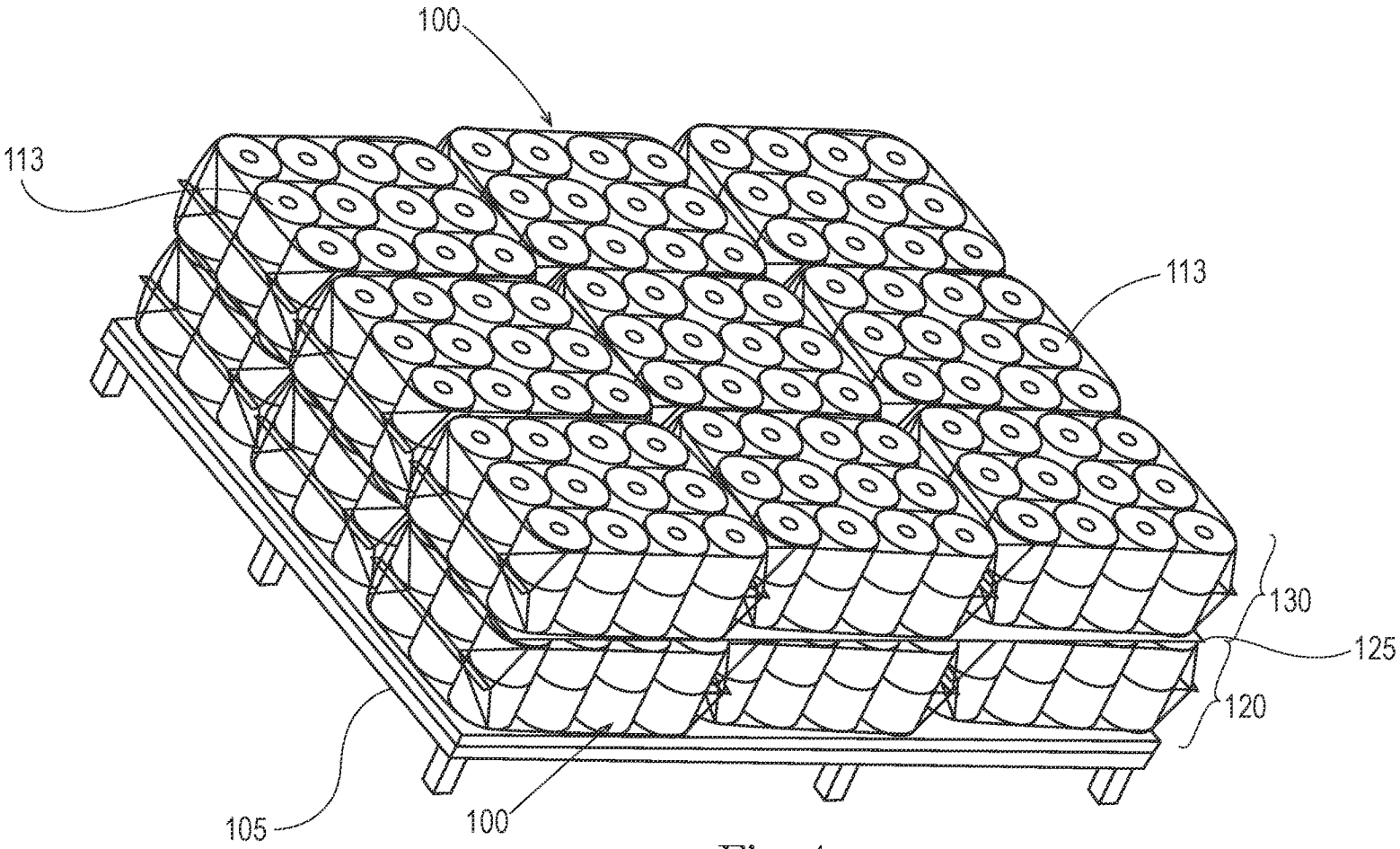
Fig. 4 (PRIOR ART)
FIG. 4 is a perspective view of the prior art example of FIG. 3 having another layer comprising a plurality of the articles of FIG. 1 disposed thereon.

Referring to FIG. 4, a second layer 130 comprising a plurality of articles 100 containing exemplary disposable rolled products 113 is disposed upon first slip sheet 125 as shown. The length and width of the articles 100 comprising second layer 130 can be generally proportioned in a manner that permits the particular articles 100 that are carried upon a pallet 105 to form a rectangle or square of selected proportions which has the same size footprint as the pallet 105 and the first layer 120 of articles 100 disposed upon pallet 105.

Figure 5:
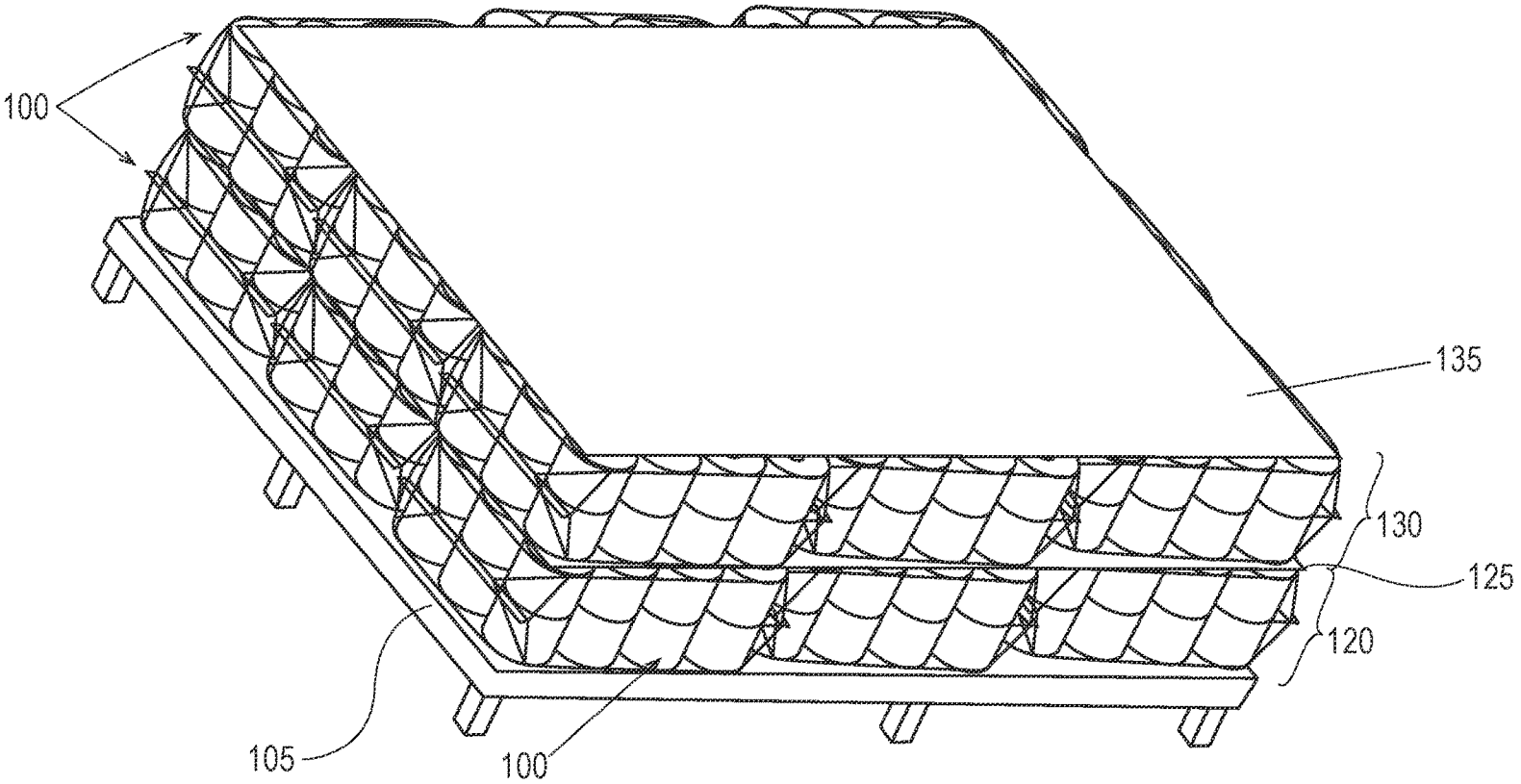
Fig. 5 (PRIOR ART)
FIG. 5 is a perspective view of the prior art example of FIG. 4 having a second slip sheet disposed thereon.

FIG. 5 depicts the placement of a second slip sheet 135 upon the top surface of the first layer 120 of articles 100 disposed upon pallet 105. Second slip sheet 135 can also provide additional structural stability to the final arrangement of articles 100 disposed upon pallet 105. Ostensibly, this is to reduce the inertia created by the columnization of a series of layers of stacked articles 100. It is also interesting to note that there is no interconnection between the individual articles 100 comprising second layer 130.

Figure 6:
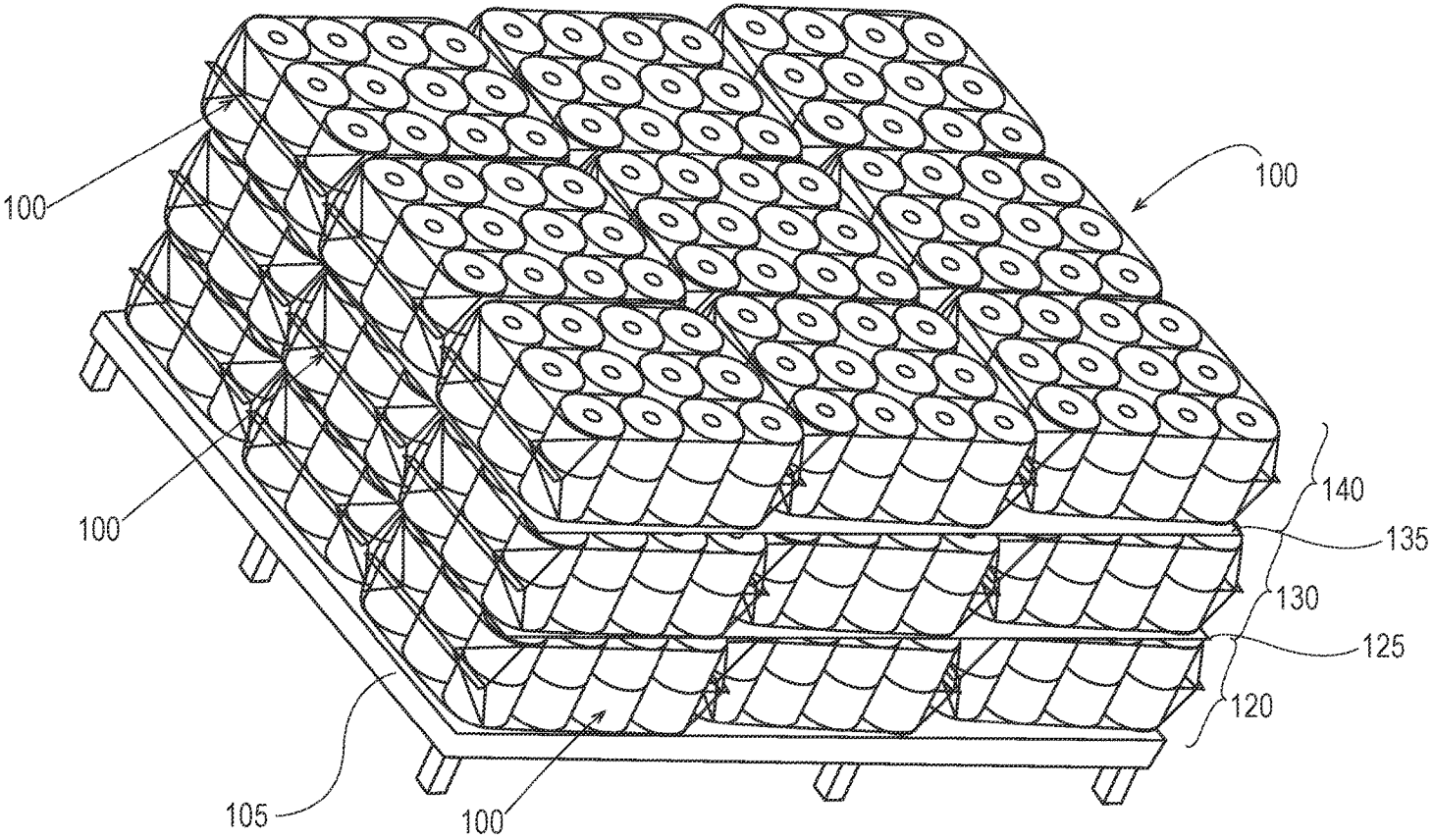
Fig. 6 (PRIOR ART)
FIG. 6 is a perspective view of the prior art example of FIG. 5 having yet another layer comprising a plurality of the articles of FIG. 1 disposed thereon.

Referring to FIG. 6, a third layer 140 comprising a plurality of articles 100 containing exemplary disposable rolled products 113 is disposed upon second slip sheet 135 as shown. The length and width of the articles 100 comprising third layer 140 can be generally proportioned in a manner that permits the particular articles 100 that are carried upon a pallet 105 to form a rectangle or square of selected proportions which has the same size footprint as the pallet 105 and the first layer 120 of articles 100 disposed upon pallet 105. The number of layers can be repeated as may be required to provide the finally formed pallet of stacked articles 100. A corresponding number of slip sheets can be disposed in between each pair of layers comprising the final pallet 105 of stacked articles 100. For example, three layers are shown, with one layer being stacked upon another and with each layer of articles 100 load being carried upon a pallet 105. Such is illustrative only and the number of layers disposed upon any given pallet 105 may be considerably more than, or less than, the three layers illustrated. Also, the number of layers forming a stack can vary and such will depend entirely upon the size and weight of the articles 100 as well as the load capacity of pallet 105.

Figure 7:
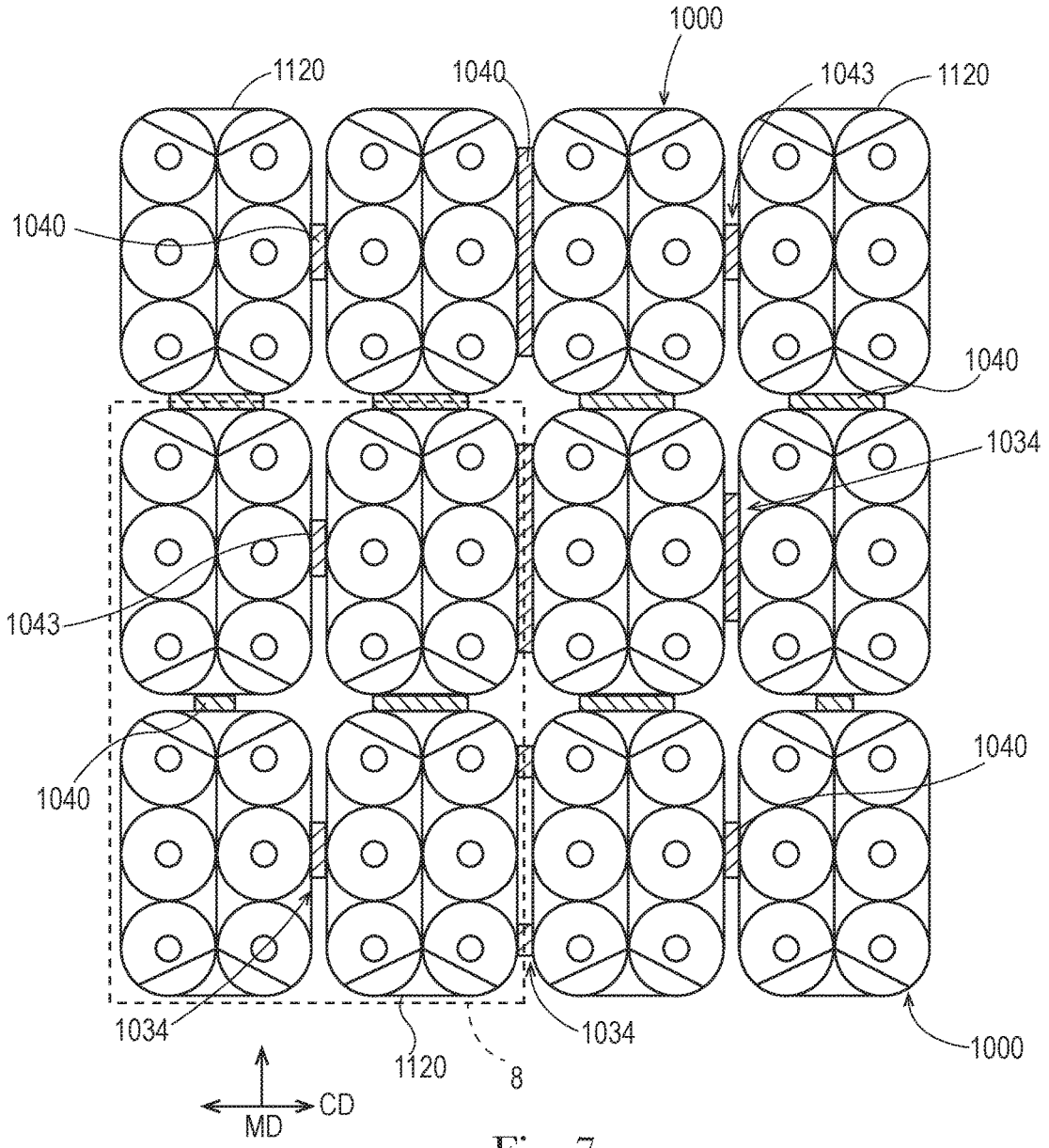
FIG. 7 is a plan view of an exemplary layer of interconnected articles suitable for placement upon a pallet.
Figure 8:
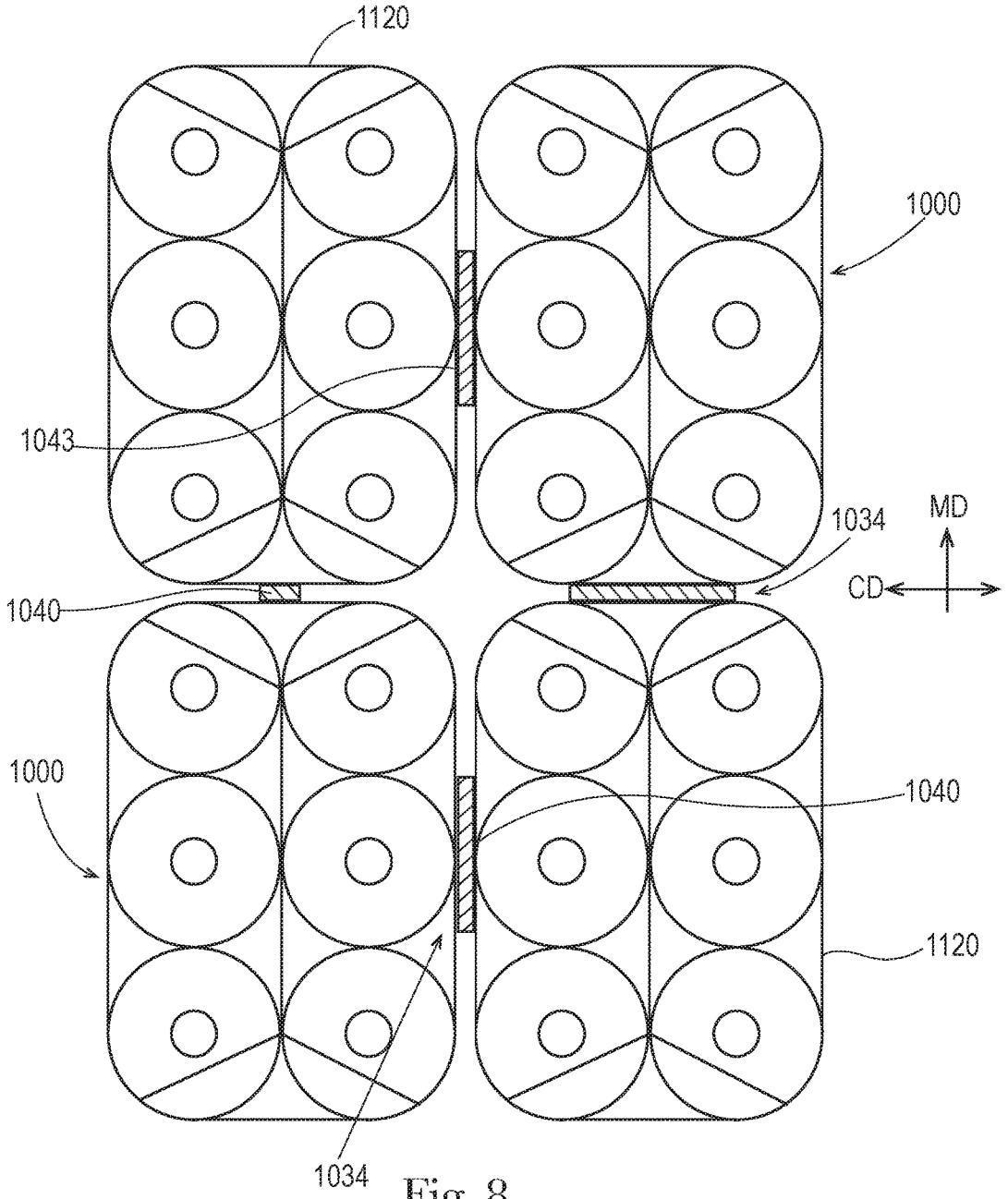
FIG. 8 is an expanded view of the Region labeled 8 in FIG. 7.
Figure 9:
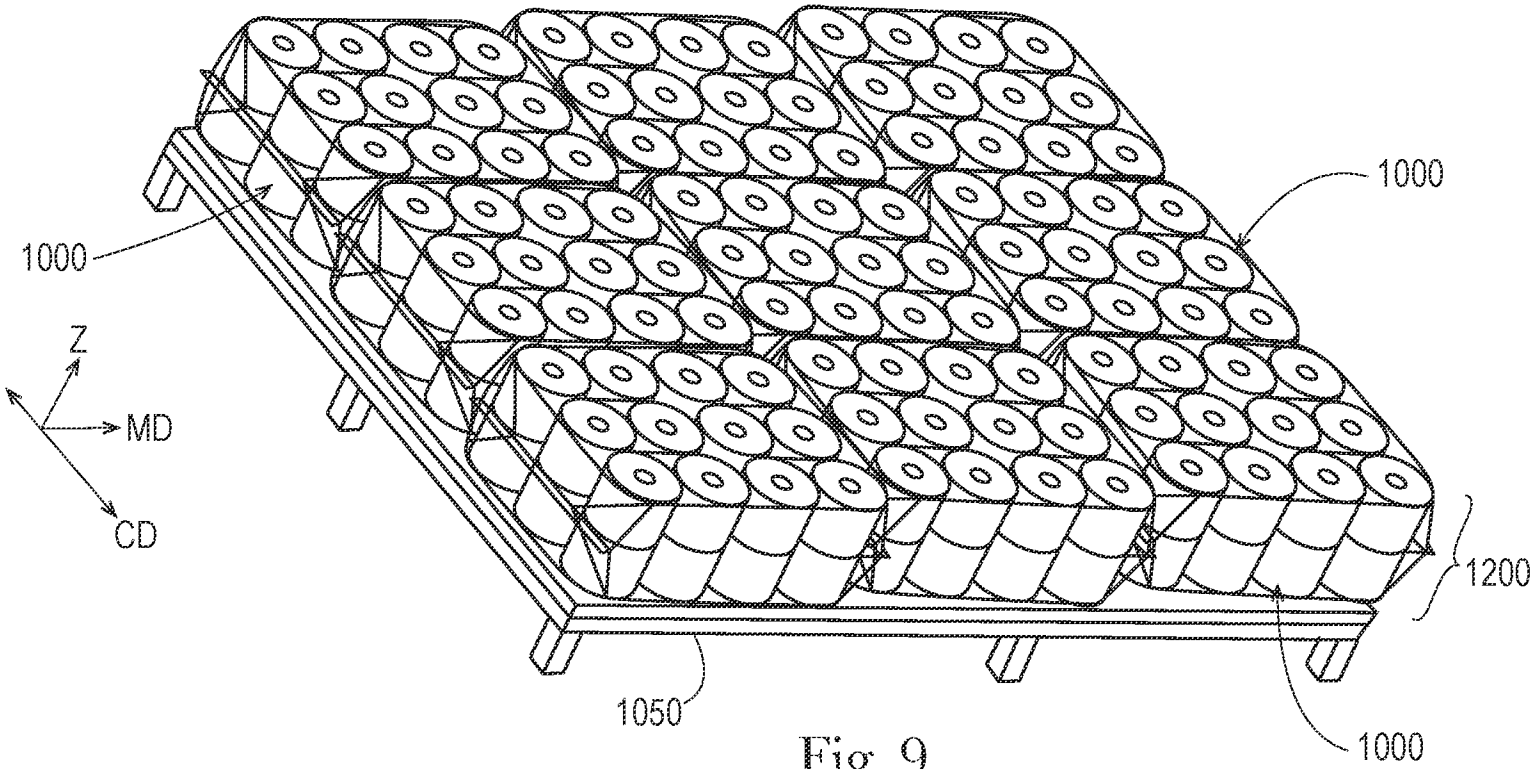
FIG. 9 is a perspective view of example of a layer comprising a plurality of interconnected articles disposed upon a pallet commensurate in scope with the present disclosure.

Turning now to FIGS. 7-9, a plurality of articles 1000 can be positioned from a supply of articles 1000 onto a surface such as pallet 1050 (also referred to herein as a supporting medium 1050) in a first layer 1200. The plurality of articles (in the form of parallelepiped, cubic, cuboid, or other solid geometric form) 1000 may be positioned on the surface of pallet 1050 in any desired arrangement or array to form first layer 1200. Each article 1000 is disposed adjacent another article 1000 so that a first sidewall of a first article 1000 is disposed immediately adjacent a first sidewall of a second article 1000 to define a space therebetween. A second sidewall of the first article 1000 can be disposed immediately adjacent a first sidewall of a third article 1000 to define a space therebetween.

In the exemplary array shown, nine articles 1000 forming first layer 1200 can be positioned onto the pallet 1050. A slip sheet may or may not be disposed upon the surface of pallet 1050 supporting the first layer 1200 of a plurality of articles.

An article 1000 (also referred to herein as a carton 1000 or a large-count package 1000) in the form of a generally parallelepiped (or any other desired solid geometry) shape is typically capable of containing goods packaged inside of the article 1000. By way of non-limiting example, article 1000 provided as a large count package containing a plurality of disposable rolled products. Disposable rolled products or disposable rolled absorbent products or disposable rolled paper products can include paper towels, facial tissues, toilet tissues, shop towels, wipes, and the like.

In exemplary embodiments, a large count package 1000 can have a generally cuboid shape, a generally rectangular cuboid shape, or any other suitable shape. In an embodiment where the large count package 1000 has a generally rectangular cuboid shape (i.e., parallelepiped), or a cuboid shape, the large count package 1000 can comprise six sides. The sides can be arranged in three pairs of generally parallel opposing sides. A first pair of the opposing sides can be a top side and a bottom side. A second pair of the opposing sides can be a front side and a back side (i.e., sidewalls). A third pair of the opposing side can be a left side and a right side (i.e., sidewalls).

In one embodiment, an adhesive 1040 (also referred to herein as glue 1040) such as an adhesive capable of cohesive and/or adhesive fracture can be deposited on at least a portion of one sidewall (or side) of each article at one or more adhesive locations 1043 of each article 1000. Each article 1000 is preferably arranged in the first layer 120 to be disposed adjacent each other so that a first sidewall of a first article 1000 is disposed immediately adjacent a first sidewall of a second article 1000 to define a first space therebetween. Preferably, the first portion of the first sidewalls of adjacent articles 1000 disposed within the first space are bonded when the articles 1000 are placed into contacting engagement. The conjoinment of adjacent articles 1000 disposed within a layer continues through the provision of spaces disposed between adjacent articles.

The number of bonding locations (such as adhesive locations 1043) and the amount of bonding required (such as the amount or type of adhesive 1040 deposited on each article 1000) can vary depending upon such factors as the types of materials comprising a first carton 1000 and an adjacent second carton 1000, the weight and type of goods contained in the first carton 1000 and the second carton 1000, whether it is desirable for the first and second cartons 1000 to be separable, and other factors as may be desired. It will also be recognized by those in the art that the desired separation force will vary according to such factors as the weight of each article 1000 and the materials used to construct the overwrap 1120 for article 1000.

As is known to those in the packaging art, there are two primary types of adhesive that could be employed for the present disclosure to bond adjacent articles 1000. One type of adhesive is hot melt glue. Hot melt glue is typically employed in production processes because it sets relatively quickly. A second type of adhesive that could be used is a cold-set glue. Cold set glues require more time in which to set than hot melt glues but typically cold set glues form stronger bonds with the overwrap material.

It has been discovered that the use of a cold-set glue may be more advantageous than use of a hot melt glue when using the present invention to construct a composite structure in which it is desired that the first article 1000 to be easily separable from a second article 1000 by an end user of the composite structure. It is believed that the cold set glue forms stronger bonds between the first article and the second article 1000 than would be formed by the use of hot melt glue. In any regard it can be preferable that the adhesive selected for application is not chemically reactive with any indicia that may be disposed upon the sidewalls of the respective articles 1000. For that matter, it can be preferable that the adhesive selected for application is not chemically reactive with any indicia that may be disposed upon the article 1000. A suitable adhesive for use with the present application may be obtained by any one of a number of known adhesive manufacturers. A particularly suitable adhesive for this application is adhesive product X3164 manufactured by Lock n' Pop®, Douglasville, Ga. Such an adhesive can be suitable for many surfaces: multi-walled bags, kraft, white, printed-graphics boxes and more, including chilled products. The adhesive works above freezing, at temperatures from 40° to 140° Fahrenheit with a lock initiation time of 2-4 minutes at a typical application rate of 1.5-3.0 grams per package. It was found that the described adhesive had a high tensile strength and could provide ultimate load stability with little or no staining, ink transfer or fiber pulling.

The placement of adhesive upon the appropriate side of a given article 1000 can require re-orientation of known adhesive dispensing apparatuses. For example, an adhesive applicator and an adhesive detector can be used for the application of adhesive to the sides of corresponding articles 1000. In practice a plurality of adhesive applicators and/or adhesive detectors may be used. One of skill in the art could provide a suitable adhesive applicator in a stationary configuration where the articles 1000 are brought proximate to the adhesive applicator and whereby the adhesive applicator applies adhesive to the sides thereof at adhesive locations 1043. Alternatively, one of skill in the art could provide a suitable adhesive application to the sides of the articles by advantageously mounting a travelling adhesive applicator mechanism that is adapted and positioned to allow the adhesive applicator or adhesive applicators to move or "sweep" over the side surfaces of the articles 1000 in order to efficiently deposit adhesive at adhesive locations 1043 as described below. Because adhesive applicators and travelling adhesive applicator mechanisms are known in the art, their structure and operation are not described in detail herein.

The amount of adhesive deposited on the side of a particular first article 1000 can determined by such factors as the length of time that adhesive flow is provided to the adhesive applicator, which is typically controlled by use of a solenoid, the length of time that the travelling adhesive applicator mechanism remains positioned near the corresponding side of each first carton 1000 applying adhesive, the pressure and flow rate of the adhesive in the adhesive applicator, and the type of adhesive used. Control of these factors to achieve a desired amount of adhesive deposited on each first carton 1000 is within the skill of those of ordinary skill in the packaging art.

The amount of adhesive applied to the corresponding side of each article 1000 can governed by whether it is desired to produce a composite structure disposed upon pallet 1050 in which a first carton 1000 is not easily separable from the conjoined second carton 1000 or whether it is desirable that the first carton 1000 is easily separable from the conjoined second carton 1000. If it is desired to produce a composite structure of conjoined articles 1000 in which the individual articles 1000 are not easily separable, then sufficient adhesive should be deposited at each adhesive location 1043 to ensure that the first article 1000 does not separate from the second article 1000 when the two articles are pulled outwardly away from each other without tearing the individual first article 1000 or second article 1000. If, on the other hand, it is desired that the first article 1000 be easily separable from the second article 1000 then the amount of adhesive deposited at each predetermined adhesive location 1043 should be sufficient to ensure that the first article 1000 remains securely adhered to the second article 1000 when the first article 1000 of the composite structure is pulled away from the second article 1000 and also remains securely adhered during normal handling of composite structure by distributors and end users. At the same time, however, in order to produce composite structures upon pallet 1050 in which the first article 1000 is separable from the second article 1000 it may be necessary that the amount of adhesive deposited at each adhesive location 1043 does not materially degrade the integrity of either the first article 1000 or the second article 1000 when the first article 1000 is urged away from the second article 1000 by an end user of the composite structure disposed upon pallet 1050.

While a preferred embodiment of the present disclosure provides for the adhesive conjoinment of adjacent articles 1000 herein, it should be clearly understood that this is non-limiting. One of skill in the art will appreciate that adjacent articles 1000 can be conjoined by numerous methods and/or techniques. By way of non-limiting example, adjacent articles 1000 or the materials used to form and contain the products inside adjacent articles 1000 can be conjoined by thermal bonding, mechanical intertwining, geometric interlocking, knurling, and the like. In principle, what is desired in conjoining adjacent articles 1000 is the occurrence and/or presence of a physical bond between, or bonding of, of adjacent articles. In other words, the act of conjoining adjacent articles 1000 seeks to unify a series or plurality of adjacent articles 1000 to act as a unitary object relative to movement within the layer of articles 1000. This can occur by thermal bonding, mechanical intertwining, geometric interlocking, knurling, adhesive bonding, and the like between adjacent articles 1000 within any given layer.

Figure 10:
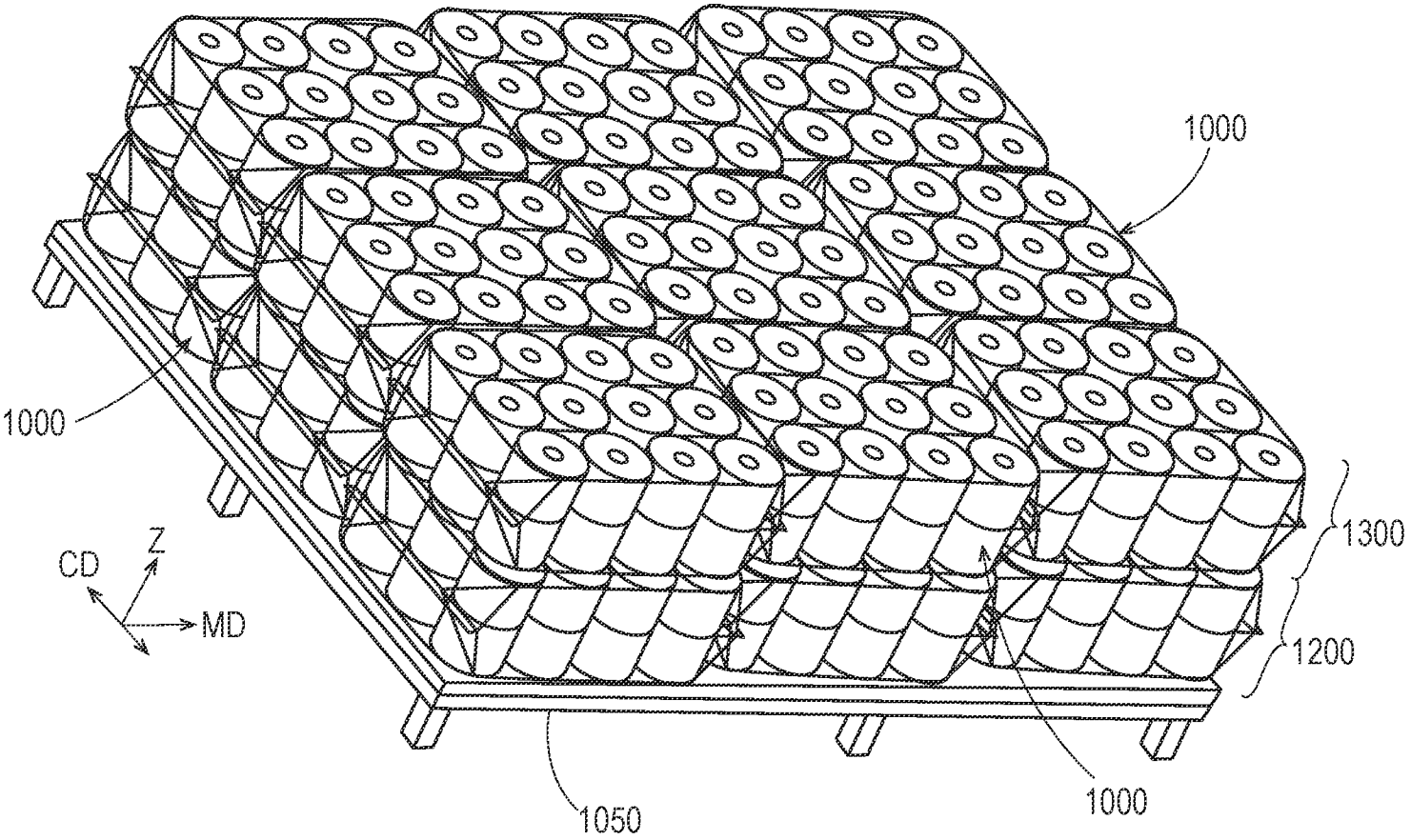
FIG. 10 is a perspective view of example of a second layer comprising a plurality of interconnected articles disposed upon the layer of interconnected articles shown in FIG. 9.

As shown in FIG. 10, corresponding second layer 1300 of adhesively conjoined articles 1000 can be disposed upon the first layer 1200 of adhesively conjoined articles 1000. In other words, a plurality of articles 1000 forming second layer 1300 is positioned adjacent to the plurality of articles 1000 forming first layer 1200. An adhesive can be deposited between each article 1000 of first layer 1200 and an adhesive can be deposited between each article 1000 of second layer 1300. As described supra, the adhesive can be deposited in the space formed between each adjacent article 1000 disposed within first layer 1200 and/or second layer 1300 in order to conjoin the adjacent articles.

Figure 11:
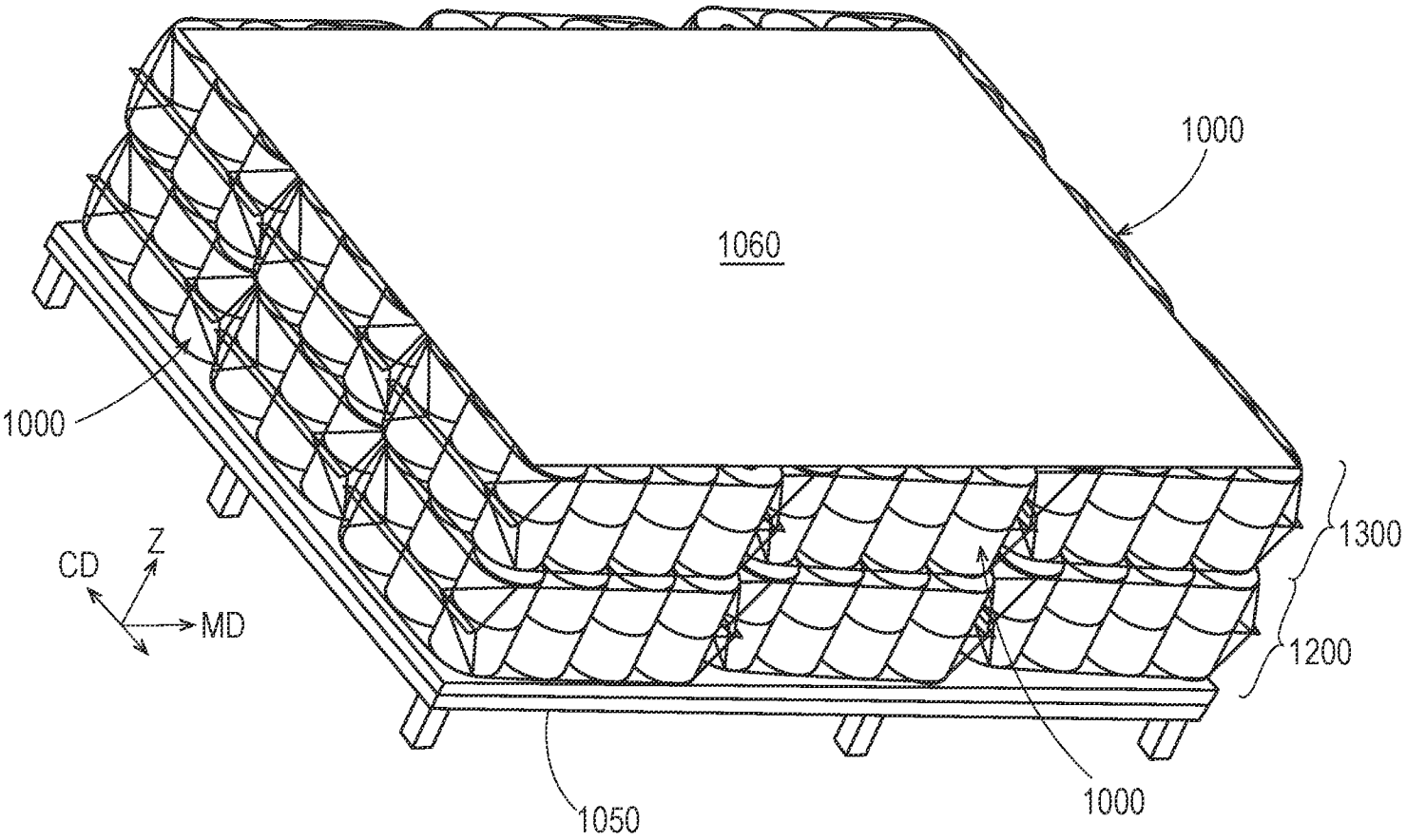
FIG. 11 is a perspective view of the example of FIG. 10 having a slip sheet disposed thereupon.

It should be noted in that the plurality of articles 1000 forming second layer 1300 can be positioned upon the plurality of articles 1000 forming first layer 1200 such that each article 1000 forming second layer 1300 is coextensive with a corresponding article 1000 forming first layer 1200. While this can often be desirable, it is not absolutely required for performance of the present disclosure. Additionally, as shown in FIG. 11, a slip sheet 1060 can be disposed upon a top surface of the second layer if so desired.

Figure 12:
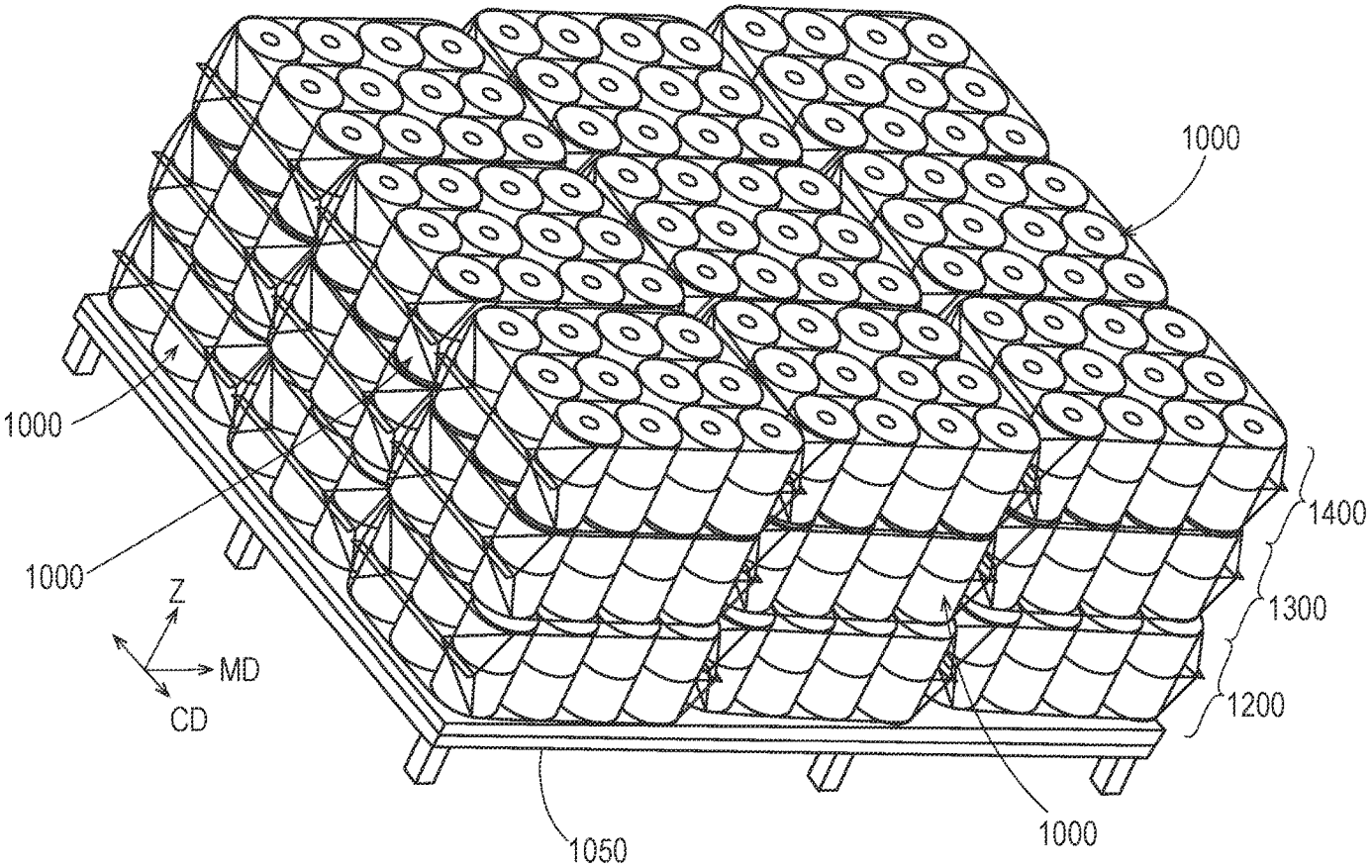
FIG. 12 is a perspective view of example of a third layer comprising a plurality of interconnected articles disposed upon the second layer of interconnected articles shown in FIG. 10.

Additionally, and as shown in FIG. 12, a third layer 1400 of adhesively conjoined articles 1000 can be disposed upon the second layer 1300 of adhesively conjoined articles 1000. This is illustrative only and the number of layers disposed upon any given pallet 1050 may be considerably more than, or less than, the three layers illustrated. Also, the number of layers forming a stack can vary and such will depend entirely upon the size and weight of the articles 100 as well as the load capacity of pallet 1050. Further, the articles 1000 of each layer in the load (i.e., first layer 1200, second layer 1300, and/or third layer 1400) can be arranged in an interlocking pattern with respect to the articles 1000 of adjacent layers to maintain the integrity of the load disposed upon pallet 1050.

The number of the adhesive locations 1043 is dictated primarily by whether it is desired to produce a composite structure in which the first article 1000 is easily separable from the second article 1000 or in which the first and second articles 1000 are not easily separable. Specifically, adhesive locations 1043 should be selected and spaced such that when the first article 1000 is separated from the second article 1000, the articles 1000 separate without tearing or otherwise significantly impairing the structural integrity of either the first article 1000 or the second article 1000.

It should be noted in that while the second layer 1300 of adhesively conjoined articles 1000 is adjacent to the first layer 1200 of adhesively conjoined articles 1000; however, the articles 1000 comprising the second layer 1300 do not need to be coextensive with the articles 1000 comprising the first layer 1200. While the articles 1000 comprising the second layer 1300 could be positioned such that all articles 1000 are coextensive with the articles 1000 comprising the first layer 1200, it has been found that varying the positioning of the articles 1000 comprising the first layer 1200 and second layer 1300 on a pallet 1050 can contribute to increased pallet 1050 stability.

Generally, it is believed that the aforedescribed process eliminates the need for slip sheets and results in that no adhesive is required to be positioned between the articles 1000 comprising first layer 1200 and the articles 1000 comprising second layer 1300. Similarly, it is believed that no adhesive is required to be positioned between the articles 1000 comprising second layer 1300 and the articles 1000 comprising third layer 1400. However, one of skill in the art may find it acceptable, or even necessary, to provide for the placement of adhesive between the articles 1000 comprising first layer 1200 and the articles 1000 comprising second layer 1300. Similarly, one of skill in the art may find it acceptable, or even necessary, to provide for the placement of adhesive between the articles 1000 comprising second layer 1300 and the articles 1000 comprising third layer 1400. The placement of adhesive between each of the respective layers may be required in order to provide a perceived need for additional structural integrity for the collection of articles 1000 disposed upon pallet 1050.

Figure 13:
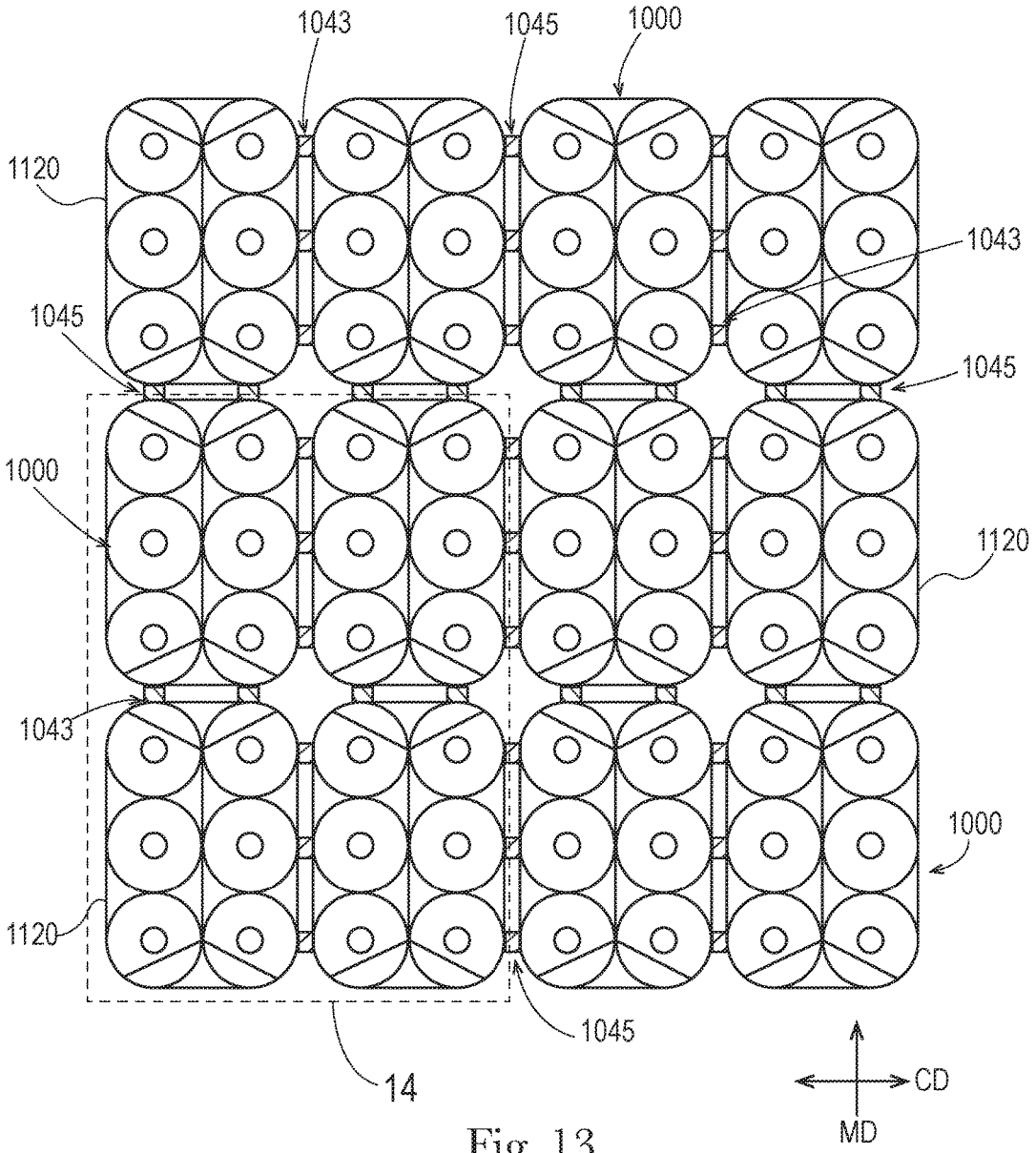
FIG. 13 is a plan view showing an exemplary layer of interconnected articles.
Figure 14:
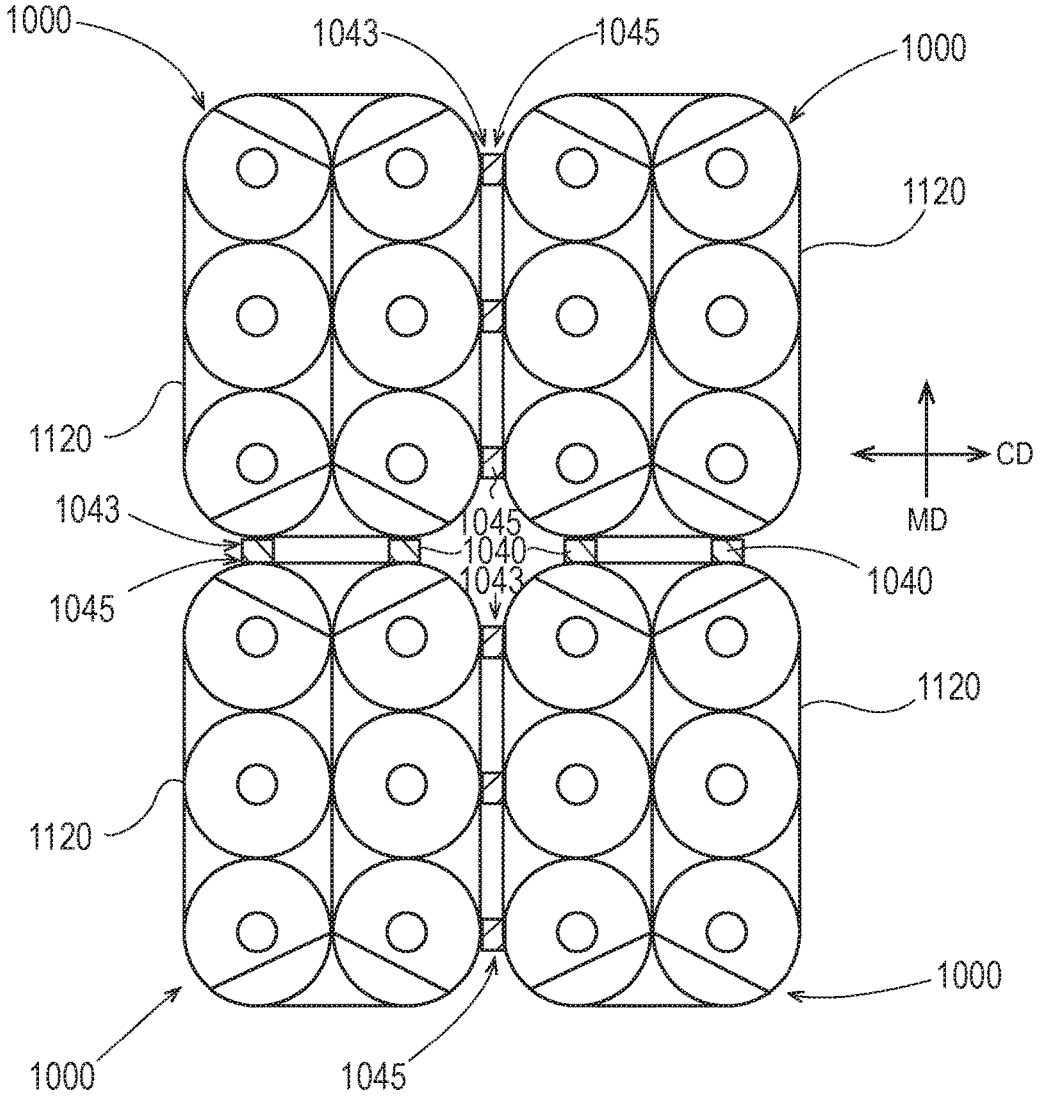
FIG. 14 is an expanded view of the region labeled 13 of FIG. 12; and, FIG. 15 is an expanded view of an alternative example of interconnected articles.

Referring now to FIGS. 13 and 14, one of skill in the art will understand that it may be useful to locate the adhesive 1040 disposed between adjacent articles 1000 of any given layer at a pre-selected adhesive location 1045. A given pre-selected adhesive location 1045 may be selected by one of skill in the art to provide the desired physical characteristics of the assembled pallet 1050 of stacked articles 1000. As illustrated in FIG. 12, an additional article 1000 is positioned adjacent to a first article 1000 disposed within a layer such that the adhesive 1040 deposited at adhesive locations 1043 on each article 1000 of the corresponding layer is thereby contained between the corresponding articles 1000 of the corresponding layer.

Even though the present disclosure provides for the possibility of an endless distribution of adhesive 1040 at any number of preselected adhesive locations 1045, one arrangement of preselected adhesive locations 1045 was found particularly suitable for use with a plurality of articles 1000 each containing disposable rolled products. After a corresponding article 1000 of any layer is placed adjacent to another corresponding article 1000 of the same layer, an adhesive 1040 can be deposited at predetermined adhesive locations 1045 on each article 1000 in the layer.

In this preferred embodiment, it was found particularly useful to provide a preselected adhesive location 1045 that is located at the tangent point of overwrap 1120 with the cylindrical outer surface of a convolutely wound web product contained therein. Without desiring to be bound by theory, it is believed that the placement of adhesive 1040 at a preselected adhesive location 1045 located at the tangent point of overwrap 1120 with the cylindrical outer surface of a convolutely wound web product contained therein can facilitate the degree (i.e., the amount) of contact between adjacent articles 1000 in any given layer disposed upon pallet 1050. This can likely be due to the fact that during a palletizing operation, the rolls contained within the overwrap of a first article 1000 are positioned immediately adjacent the rolls contained within the overwrap of a second article 1000. The rolls being so positioned can increase the structural and inertial stability of the finally formed stack of articles dispose upon a pallet 1050. Therefore the placement of adhesive 1040 therebetween can take further advantage of the aforementioned structural and inertial stability and yet still further increase the structural and inertial stability of the finally formed stack of articles dispose upon a pallet 1050.

Figure 15:
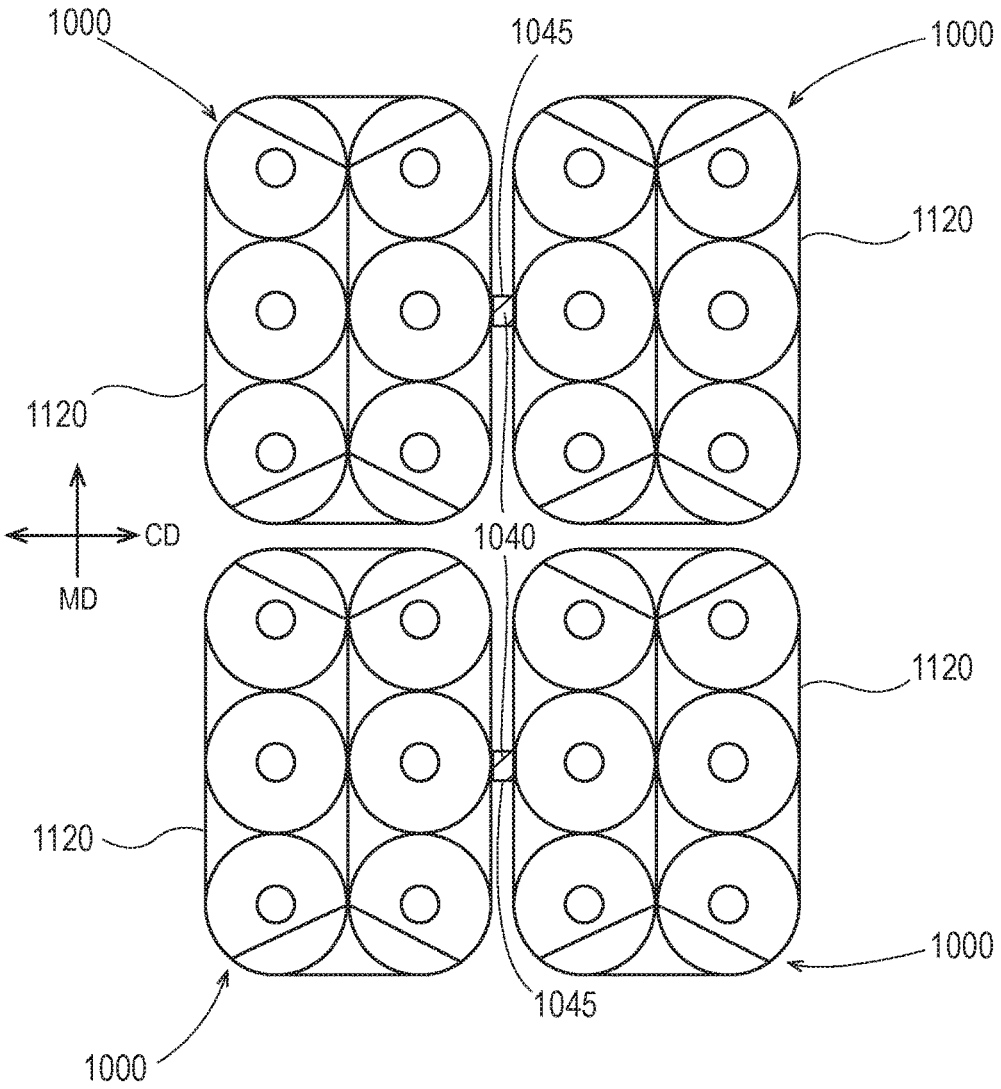

As shown in FIG. 15, one of skill in the art can minimize the amount of adhesive 1040 disposed between opposed adjacent surfaces of overwrap 1120 separating adjacent articles 1000. By way of non-limiting example, preselected adhesive locations 1045 can be provided as only one point of contact upon the respective surfaces of overwrap 1120 disposed between adjacent articles 1000. In such an application, it may be preferable to provide preselected adhesive location 1045 between adjacent tangent points of overwrap 1120 with the cylindrical outer surface of a convolutely wound web product contained therein of the respective adjacent articles 1000. Additionally, the volume of adhesive 1040 applied between the corresponding adjacent articles 1000 can be adjusted as required by one of skill in the art to provide the desired degree of bonding attachment between adjacent articles 1000. For example only, the volume or type of adhesive 1040 applied between adjacent articles 1000 can be affected by the amount of adhesion required between adjacent articles 1000, the viscosity of the adhesive 1040, the shear strength of adhesive 1040, the material forming overwrap 1120, and the like.

As described above, successive layers can be positioned to be coextensive with or not coextensive with layers previously deposited upon pallet 1050. A adhesive detector may be used to detect the presence or absence of adhesive at each adhesive location 1043.

All publications, patent applications, and issued patents mentioned herein are hereby incorporated in their entirety by reference. Citation of any reference is not an admission regarding any determination as to its availability as prior art to the claimed invention.

The dimensions and/or values disclosed herein are not to be understood as being strictly limited to the exact numerical values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A collection of stackable articles, each stackable article of said collection of stackable articles having a bottom, at least one sidewall, and a top, and contains a plurality of convolutely wound rolls of web material, each convolutely wound roll of web material having a longitudinal axis parallel with said at least one sidewall, the collection of stackable articles comprising:

a supporting medium selected from the group consisting of a basket, a bin, a box, a case, a catch-all, a chest, a container, a crate, a envelope, a mold, a packing case, a packing crate, a pallet, a pocket, a receptacle, and a tin;

a first slip sheet disposed upon a surface of said supporting medium;

a first plurality of said stackable articles arranged in a first layer upon said first slip sheet, each stackable article of said first plurality of stackable articles being disposed adjacent each other so that a first at least one sidewall of a first stackable article of said first plurality of stackable articles is disposed immediately adjacent a first at least one sidewall of a second stackable article of said first plurality of stackable articles to define a first space therebetween; and, wherein a first portion of said first at least one sidewall of said first stackable article of said first plurality of stackable articles disposed within said first space is bonded to a first portion of said first at least one sidewall of said second stackable article of said first plurality of stackable articles disposed within said first space when said first stackable article of said first plurality of stackable articles and said second stackable article of said first plurality of stackable articles are placed into contacting engagement.

2. The collection of stackable articles of claim 1 wherein:

a first at least one sidewall of a third stackable article of said first plurality of stackable articles being disposed immediately adjacent said first at least one sidewall of said second stackable article of said first plurality of stackable articles to define a second space therebetween; and, wherein a second portion of said first at least one sidewall of said second stackable article of said first plurality of stackable articles disposed within said second space is bonded to a first portion of said first at least one sidewall of said third stackable article of said first plurality of stackable articles disposed within said second space when said second stackable article of said first plurality of stackable articles and said third stackable article of said first plurality of stackable articles are placed into contacting engagement therewith.

3. The collection of stackable articles of claim 1 further comprising:

a second plurality of said stackable articles arranged in a second layer, said second layer being disposed upon said first layer, each stackable article of said second plurality of stackable articles being disposed adjacent each other so that a first at least one sidewall of a first stackable article of said second plurality of stackable articles is disposed immediately adjacent a first sidewall of a second stackable article of said second plurality of stackable articles to define a third space therebetween;

wherein a first portion of said first sidewall of said first stackable article of said second plurality of stackable articles disposed within said third space is bonded to a first portion of said first at least one sidewall of said second stackable article of said second plurality of stackable articles disposed within said third space when said first stackable article of said second plurality of stackable articles and said second stackable article of said second plurality of stackable articles are placed into contacting engagement.

4. The collection of stackable articles of claim 3 wherein:

a first at least one sidewall of a third stackable article of said second plurality of stackable articles is disposed immediately adjacent said first at least one sidewall of said second stackable article of said second plurality of said stackable articles to define a fourth space therebetween; and, wherein a second portion of said first at least one sidewall of said second stackable article of said second plurality of stackable articles disposed within said fourth space is bonded to a first portion of said first at least one sidewall of said third stackable article of said second plurality of stackable articles disposed within said fourth space when said second stackable article of said second plurality of stackable articles and said third stackable article of said second plurality of stackable articles are placed into contacting engagement.

5. The collection of stackable articles of claim 3 further comprising a second slip sheet disposed upon a top surface of said second layer.

6. The collection of stackable articles of claim 5 wherein said second slip sheet is adhesively attached to said top surface of said second layer.

7. The collection of stackable articles of claim 1 wherein said bonding of said first portion of said first at least one sidewall of said first stackable article of said first plurality of stackable articles disposed within said first space to said first portion of said first at least one sidewall of said second stackable article of said first plurality of stackable articles disposed within said first space further comprises bonding said first portion of said first at least one sidewall of said first stackable article of said first plurality of stackable articles disposed within said first space to said first portion of said first at least one sidewall of said second stackable article of said first plurality of stackable articles disposed within said first space at a position that is tangent to the surface of said convolutely wound roll of web material and in contacting engagement with said first at least one sidewall of said first stackable article of said first plurality of stackable articles.

8. The collection of stackable articles of claim 1 wherein said bonding comprises an adhesive disposed upon said first at least one sidewall of said first stackable article of said first plurality of stackable articles disposed within said first space.

9. The collection of stackable articles of claim 8 wherein said adhesive is capable of cohesive fracture.

10. The collection of stackable articles of claim 8 wherein said adhesive is capable of adhesive fracture.

11. The collection of stackable articles of claim 8 wherein said adhesive is not chemically reactive with indicia disposed upon said first at least one sidewall of said first stackable article of said first plurality of stackable articles.

12. The collection of stackable articles of claim 8 wherein a portion of said adhesive is disposed upon each first at least one sidewall of each stackable article disposed within said first layer in a region proximate to a first at least one sidewall of an adjacent stackable article disposed within said first layer.

* * * * *